US011388940B2

(12) United States Patent
Narahari

(10) Patent No.: US 11,388,940 B2
(45) Date of Patent: Jul. 19, 2022

(54) AUTO GLOVE DEVICE

(71) Applicant: Viswanatham Narahari, Edison, NJ (US)

(72) Inventor: Viswanatham Narahari, Edison, NJ (US)

( * ) Notice: Subject to any disclaimer, the term of this patent is extended or adjusted under 35 U.S.C. 154(b) by 0 days.

(21) Appl. No.: 16/528,588

(22) Filed: Jul. 31, 2019

(65) Prior Publication Data

US 2020/0037684 A1 Feb. 6, 2020

Related U.S. Application Data

(60) Provisional application No. 62/712,315, filed on Jul. 31, 2018.

(51) Int. Cl.

| | |
|---|---|
| ***A41D 19/02*** | (2006.01) |
| ***A47G 25/90*** | (2006.01) |
| ***A41D 19/04*** | (2006.01) |

(52) U.S. Cl.

CPC ..... *A41D 19/02* (2013.01); *A41D 19/046* (2013.01); *A47G 25/904* (2013.01); *A41D 19/04* (2013.01)

(58) Field of Classification Search

CPC ..... A41D 19/02; A41D 19/04; A41D 19/046; A47G 25/904; A61B 42/50

USPC ..... 223/111

See application file for complete search history.

(56) References Cited

U.S. PATENT DOCUMENTS 5,868,290 A * 2/1999 Green, Sr. ..... A47G 25/904 223/111

2018/0289190 A1* 10/2018 Avshalom ..... A61B 42/50

* cited by examiner

*Primary Examiner* — F Griffin Hall

(57) ABSTRACT

Disclosed herein is are systems, methods, and devices for automatically custom-fitting one or more glove on a user hand.

11 Claims, 3 Drawing Sheets

AUTO GLOVE DEVICE

CROSS-REFERENCE TO RELATED APPLICATION

This application claims priority to and claims the benefit of priority to U.S. Patent Application No. 62/712,315 filed on Jul. 31, 2018 and entitled "Auto Glove Device". The entirety of the disclosure of the aforementioned application is considered part of, and is incorporated by reference in, the disclosure of this application.

TECHNICAL FIELD

This application relates to devices, systems and methods for automatically custom fitting one or more glove to a hand.

BACKGROUND

The ability of arranging gloves on a user hand is an antiquated process requiring unnecessary time and energy. A user must open a glove, which is sometimes made of a flimsy latex material that requires careful focus and concentration. Then the user must insert their hand into the glove opening and make several adjustments to get the fingers and palm snugly within the glove material. This process is a nuisance, time consuming and inefficient. In several cases it also places people in jeopardy, for instance, in the case where a surgeon needs to perform emergency surgery but first spends time gloving his hands appropriately. As such, there is a need for technological improvements with the gloving process.

SUMMARY

The following presents a summary to provide a basic understanding of one or more embodiments of the invention. This summary is not intended to identify key or critical elements, or delineate any scope of the particular embodiments or any scope of the claims. Its sole purpose is to present concepts in a simplified form as a prelude to the more detailed description that is presented later. In one or more embodiments described herein, systems, devices, apparatuses, and/or methods that facilitate an automated gloving of on a user hand are disclosed. According to an embodiment of the present invention, a device can include an automated gloving device that custom fits a glove around a user hand.

DETAILED DESCRIPTION

The following detailed description is merely illustrative and is not intended to limit embodiments and/or application or uses of embodiments. Furthermore, there is no intention to be bound by any expressed or implied information presented in the preceding Background or Summary sections, or in the Detailed Description section. One or more embodiments are now described with reference to the drawings, wherein like referenced numerals are used to refer to like elements throughout. In the following description, for purposes of explanation, numerous specific details are set forth in order to provide a more thorough understanding of the one or more embodiments. It is evidence, however, in various cases, that the one or more embodiments can be practiced without these specific details.

In an aspect, disclosed herein are devices, systems, and methods that fit a glove to a user hand upon demand. The use of gloves is so important for users in several industries. For instance, in a medical setting glove use reduces the risk of contaminating the hands of the user with blood and other body fluids as well as reduce the risk of germs spreading to an environment such as a patients' body. Unfortunately, a range of challenges arise in association with a user putting on gloves. Some problems can include the gloves sticking to a user fingers, a glove being an improper size for the user (e.g., too large has excess material and too small causes constriction and other discomforts), and other such challenges.

The disclosed invention can be utilized in several industries including the medical industry with an assortment of users (e.g., physicians, hospitals, clinics, medical offices, operation theaters, etc.), grocery industry (e.g., any store where a glove is needed), car industry (e.g., mechanical car repair), and other such industries. In an aspect, the disclosed invention can minimize the time to which a glove can be custom fitted to a hand as compared to current methods of manually fitting a glove to a hand. In a non-limiting embodiment, the device can employ a single finger operation and perform such operation in a more hygienic manner than current methods of putting on a glove.

In a non-limiting example, a user can be a dentist that uses the automated glove device to put gloves on his hand prior to checking a patient and do so in an optimal manner within a few moments. As such, if there is a complication with a patient, the dentist can change gloves and switch servicing between patients at a quicker pace than currently possible. In another instance, a user can perform an operation and switch between glove uses within seconds.

Figure 1:
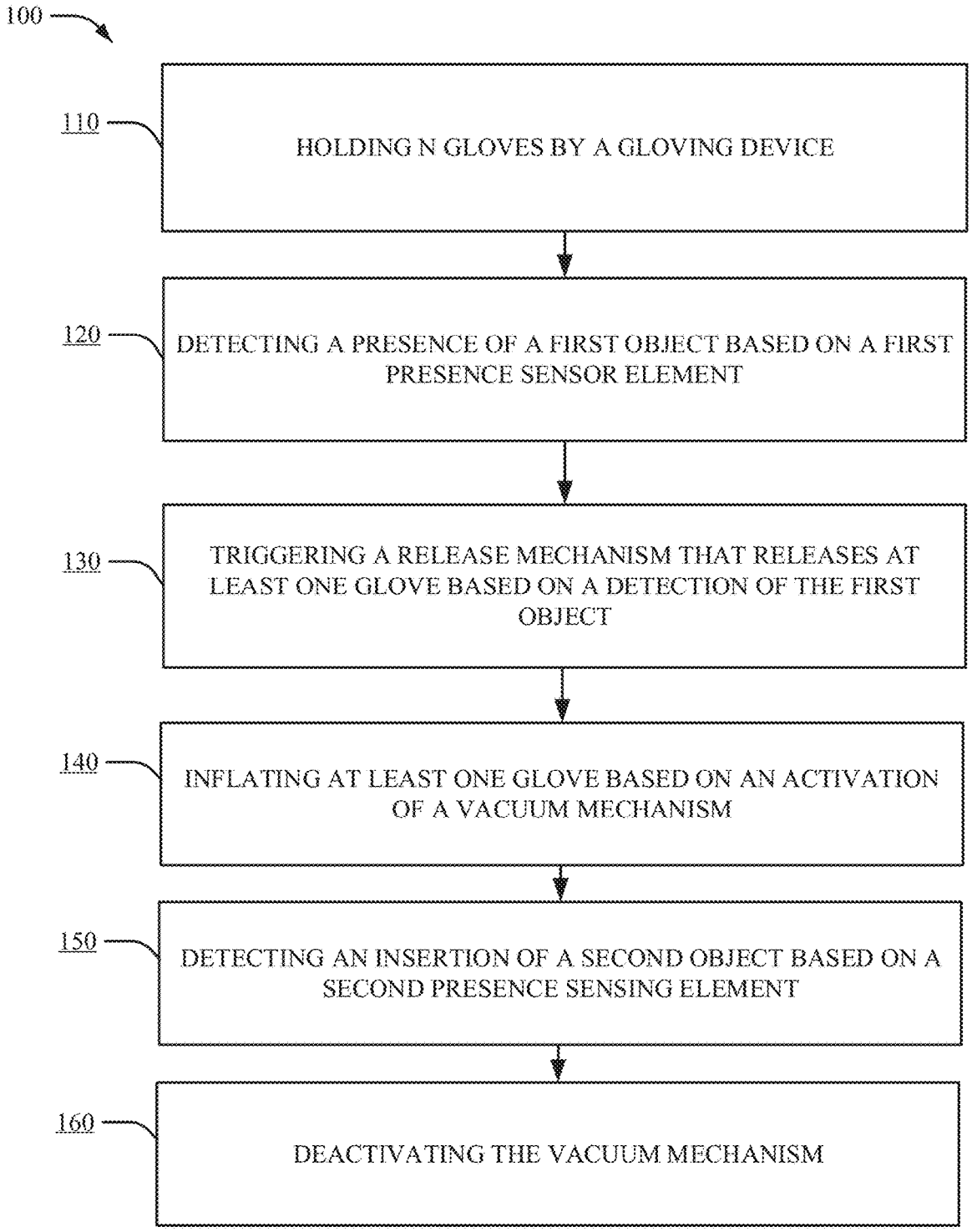
FIG. 1 illustrates a block diagram of an example, non-limiting method 100 that can facilitate a user to perform an automated fitting of a glove.

Turning now to FIG. 1, illustrated is a device 100 and method for automatically fitting a glove to a user hand. At reference numeral 110, the automated glove device 100 can hold N (unfitted) gloves, wherein N is a number of unfitted gloves capable of being fitted around a user hand using device 100. The unfitted gloves can be stored as a stack of gloves within device 100 for intake and transformation into a custom-fitted glove by the device. At reference numeral 120, the device 100 can employ a first sensor component capable of detecting the presence of a first object such as a user. For instance, the first sensor component can be a sensor that detects the presence of a user body standing in front of the device to begin deploying the release mechanism of the unfitted raw glove. In another instance the first sensor component can be a retina detector that detects the presence of a user eye in order to facilitate a triggering of the release of the unfitted glove.

At reference numeral 130, the first sensor component of the device 100 can be triggered based on the presence of an object (e.g., user). At reference numeral 140, based on the presence of the object, the device 100 can employ a release mechanism that releases at least one glove into a chamber component of device 100. In an aspect, the chamber component of device 100 can be a cavity by which a glove can be expanded to initiate the fitting process around a second object such as a user hand. At reference numeral 150, the device can employ an inflation component that inflates the at least one glove, wherein the inflated at least one glove comprises an opening. For instance, a vacuum mechanism of device 100 can be employed to inflate the unfitted glove that and procures an opening. At reference numeral 160, the device can employ a second sensor component capable of detecting an insertion of a second object to satisfy a threshold level of insertion. For instance, a user can insert its hand into the opening of the inflated and unfitted glove, and upon the hand being inserted fully (e.g., satisfying a threshold level of hand insertion as measured by a second sensor) then the vacuum mechanism can be deactivated resulting in the glove shrinking to the customized size of the user hand. Thus, resulting in a custom fitted glove being fit around the user hand(s). At reference numeral 170, the device can deactivate the vacuum component mechanism based on the threshold level of hand insertion being satisfied resulting in the at least one glove being custom fitted to the user hand(s). In another aspect, the user can remove his hands from the device with custom fitted gloves circumscribing his hands. This automated gloving device 100 and corresponding mechanism can happen in only a few moments in some non-limiting embodiments.

In another non-limiting embodiment, the device 100 can include a removal component that removes and/or disposes gloves from a user hand based on a user inserting one or more gloved hand into the device 100. Furthermore, in an aspect device 100 can inflate the glove that is around the user hand and remove such glove and then dispose of such glove in an automated manner.

Figure 2:
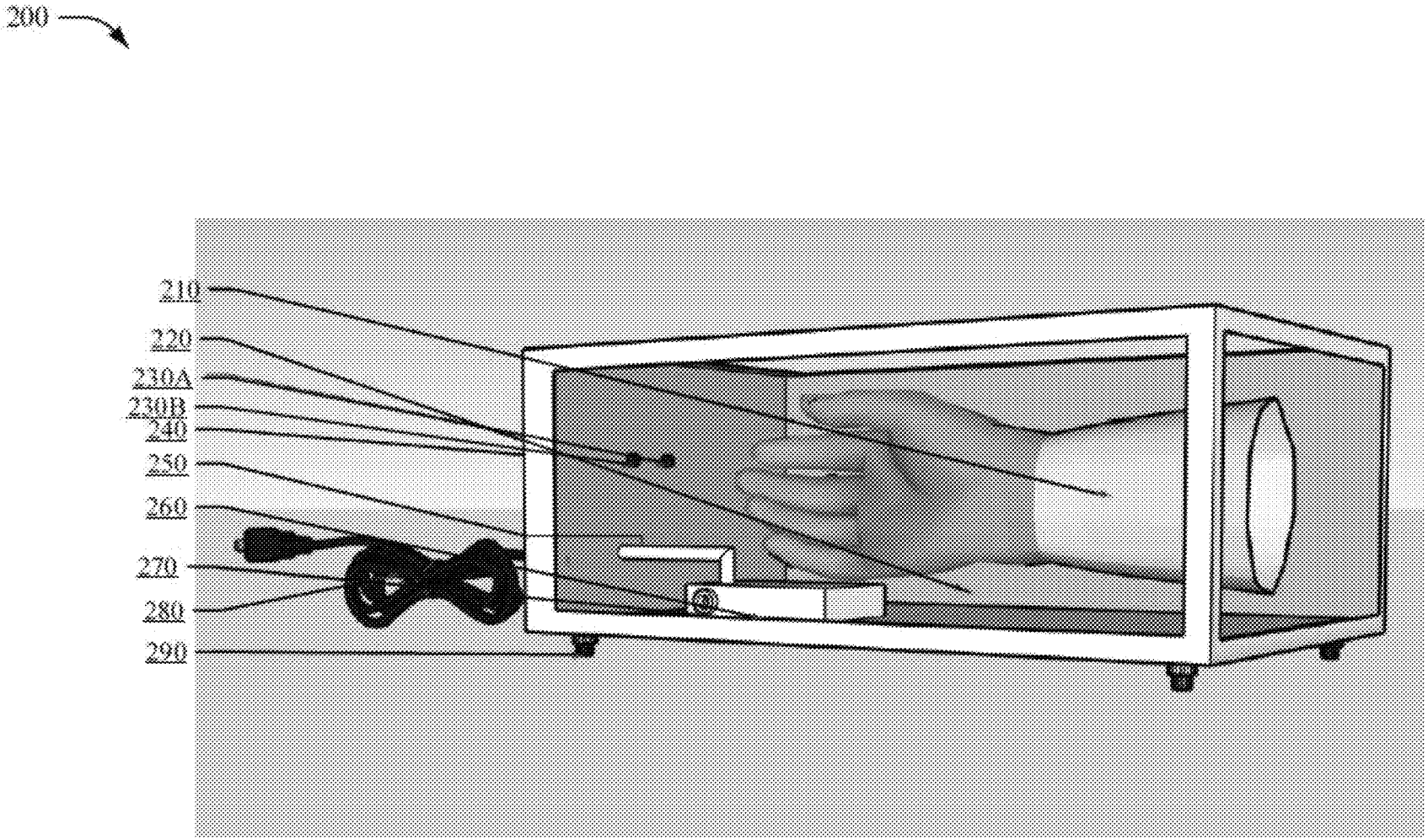
FIG. 2 illustrates a diagram of an example, non-limiting automated glove device 200 in accordance with one or more embodiments described herein.

Turning now to FIG. 2, illustrated is a non-limiting automated gloving device 200. In an aspect, referenced are glove element 210, glove device chamber 220, glove presence sensor 230, vacuum deactivate switch 240, air in/out pipe 250, vacuum motor holder 260, vacuum hole 270, power cord 280, level holder element 290. In an aspect, glove element 210 can be any type of glove having a range of material compositions and a range of uses. For instance, glove element 210 can be a disposable or non-disposable glove having a material composition of one or more of nitrile, latex, chloronite, rubber (e.g., butyl rubber), neoprene, viton and/or vinyl (e.g., polyvinyl alcohol). Furthermore, glove element 210 can comprise a range of thicknesses such as 400-1000 microns thickness for example. In another aspect, glove element 210 can comprise various styles such as cuff length variations (e.g., longer vs. shorter), material compositions (e.g., permeability variations, resistance variations, etc.). In another aspect, glove element 210 can be gloves configured for a range of uses such as medical uses, gardening uses, cleaning uses, and other such uses.

In a non-limiting embodiment, gloving device 200 can be configured to automatically apply glove element 210 onto a user hand in a fast, efficient and fitted manner. As such, gloving device 200 overcomes issues associated with ill fitted gloves such as injury, contamination susceptibility, reduced grip, dexterity impediments, puncture vulnerabilities, hand inflexibility, contaminant transfer onto the glove by use of an ungloved hand to assist with glove fitting. As such, in a non-limiting embodiment gloving device 200 can employ glove chamber 220 that contains gloving device 200 components including glove element 210. In a non-limiting embodiment, gloving chamber 220 can be configured as a rectangular compartment with a roof portion, a floor portion, a first wall portion, a second wall portion, a third wall portion, and a fourth wall portion. In a non-limiting embodiment, the fourth wall portion can include a hole that includes a sleeve (e.g., a rubber sleeve) that has a glove element 210 circumscribing the end portion of the sleeve. As such, the glove can detach from the end of the sleeve to which it circumscribes.

In another non-limiting embodiment, gloving device chamber 220 can integrate with a glove presence sensor 230 that detects object data representing the presence of glove element 210. For instance, upon insertion of a glove element 210 into gloving device chamber 220, presence sensor 230 can detect the presence of glove element 210 and trigger a vacuum mechanism that inflates glove element 210 based on a pressure difference created between the inner cavity of gloving device chamber 220 and the outside environment of gloving device chamber 220. In an aspect, glove presence sensor 230 can be mounted to a wall of gloving device chamber 220 in order to be proximally situated to any glove element 210 that enters the gloving device chamber 220. In one or more embodiments, glove presence sensor 230 can sense movement of an object such as a glove or hand within the inner cavity of the chamber. For instance, if a movement of half a centimeter occurs from the rest position of the glove or hand, then glove presence sensor 230 can detect such movement. In some embodiments, a detection of movement determined to be above a threshold movement value (e.g., movement of a certain distance) can trigger the sensor to transmit a signal to a vacuum motor to activate. However, in some instances a movement below such threshold may not trigger such vacuum motor to activate.

In an aspect, upon the detection of an object (e.g., glove) by glove presence sensor 230, such sensor 230 can generate object data that can be transmitted (e.g., as an electrical signal or via a executable instruction executed by a processor communicatively connected to device 200) to vacuum motor holder 260. In an aspect, vacuum motor holder 260 configured to house a vacuum motor element configured to create a low pressure inside the cavity of gloving device chamber 220. For instance, the vacuum motor can utilize turbine energy to create a vacuum pull force that pulls the air from inside the inner cavity of gloving device chamber 220 and transmits the air into the outside environment of gloving device chamber 220.

In an aspect, the air from inside the chamber cavity can be pulled through vacuum hole 270, pass through vacuum motor holder 260 and exit in the outside environment through air in/out pipe 250. In a non-limiting embodiment, the vacuum motor holder 260 (e.g., controller box) can be mounted (e.g., to a floor of the chamber) inside the cavity of gloving device chamber 220 as well as a vacuum motor encapsulated by such motor holder 260. Furthermore, the vacuum hole 270 can be configured as an opening that interfaces between the vacuum motor holder 260 and the inner cavity environment of gloving device chamber 220. In yet another aspect, air in/out pipe 250 can be connected to a surface of vacuum motor holder 260 (e.g., one end of the pipe opens into the holder cavity) and another end of air in/out pipe can be connected to a wall of gloving device chamber 220 and the pipe opening can open into the environment outside of the inner cavity. Accordingly, upon activation of the vacuum mechanism (e.g., powered by electricity through a power cord) the air inside the cavity of gloving device chamber 210 can be vacuumed through vacuum hole 270, into vacuum motor holder 260, through air in/out pipe 250 and outside of the chamber.

In yet another non-limiting embodiment, gloving device 200 can be configured with a vacuum deactivate switch 240. In an aspect, the vacuum deactivate switch 240 can be communicatively connected or electrically connected to the vacuum motor. As such, a trigger of vacuum deactivate switch 240 can deactivate the vacuum mechanism and stop the glove element 210 from inflating. In an aspect, the glove element 210 can expand to a range of different pressure levels based on variations in glove types (e.g., material composition, glove strength, etc.) and such pressure level can be maintained or varied in various embodiments. As an example, upon the vacuum motor creating low pressure in the gloving device chamber 220, glove element 210 can inflate based on such pressure differentiation. A user can insert his or her hand through the sleeve in the side of gloving device 200 and into the inflated glove. Furthermore, the user (now with hand inserted into the inflated glove) can trigger (e.g., trip or push a button) the deactivate switch which can deactivate the vacuum motor and end the generation of the vacuum suction and external air enters the cavity of chamber glove device chamber 220. As a result of the pressure loss, glove element 210 can constrict around the user hand thus creating a custom fitted glove that surrounds the user hand (e.g., fingers, palm, sleeve, etc.). Furthermore, the user can pull the glove fitted hand out of the chamber cavity. Accordingly, such process occurs expediently and seamlessly overcoming traditional challenges associated with applying gloves to hands.

In another non-limiting embodiment, glove presence sensor 230 or a proximity sensor can detect the proximity of object data (e.g., closeness of the hand inside the glove to the proximity sensor) to automatically trigger (via transmission of an electrical or network signal) the vacuum motor to activate a vacuum mechanism (e.g., using air in/out pipe 250) that inflates glove element 210. Furthermore, in an aspect, vacuum deactivate switch 240 can be triggered (e.g., a user hand pushing the switch button while wearing the glove inside the cavity chamber) by a user hand. In other embodiments, a deactivation of the vacuum mechanism can be based on a change in object data values detected by glove presence sensor 230. For instance, the absence of the object data being detected or the absence in motion associated with object data (e.g., a hand detection in a different position, a glove detection at a different location) can trigger the vacuum deactivate switch 240 to deactivate the vacuum mechanism.

Upon such vacuum deactivation, glove element 210 can shrink to the shape of the hand within the cavity of the glove element 210 thus allowing for a fitted glove to encase a user hand. Furthermore, the fitted glove element 210 around a user hand is free from contamination (e.g., no other hand or object touched the glove exterior to effectuate the glove fitting around the hand), the glove is fitted perfectly to the user hand (no odd stretching, slack or undesired wrinkles, etc.). In another aspect, vacuum motor holder 260 can include a motor that supplies motion power (e.g., via a turbine, rotating fan, or other mechanism) to generate the vacuum force within the chamber cavity to expand glove element 210 for insertion of a user hand.

In another aspect, device 200 can employ a vacuum hole 270 configured to adjust the force of the vacuum suction mechanism to generate areas of low pressure and areas of high pressure within the glove chamber 220. For instance, a partial or full opening of such hole can allow high pressure air outside of glove chamber 220 to enter inside the glove chamber 220. In another aspect, the vacuum hole 270 can be opened and closed to various degrees to vary the suction level of the vacuum for various time periods (e.g., temporarily) and to various strengths. As such, the vacuum mechanism can be carefully calibrated to accommodate the opening of fragile glove element 210 to accommodate a hand to enter. In yet another aspect, power cord 280 can be connected to glove chamber 220 to supply power such as electricity to device 200 components such as a vacuum motor and other components. In yet another aspect, device 200 can employ level holder element 290 integrated into the exterior portion (e.g., underside) of glove chamber 220 to stabilize and support the entire glove chamber 220 portion of device 200.

Figure 3:
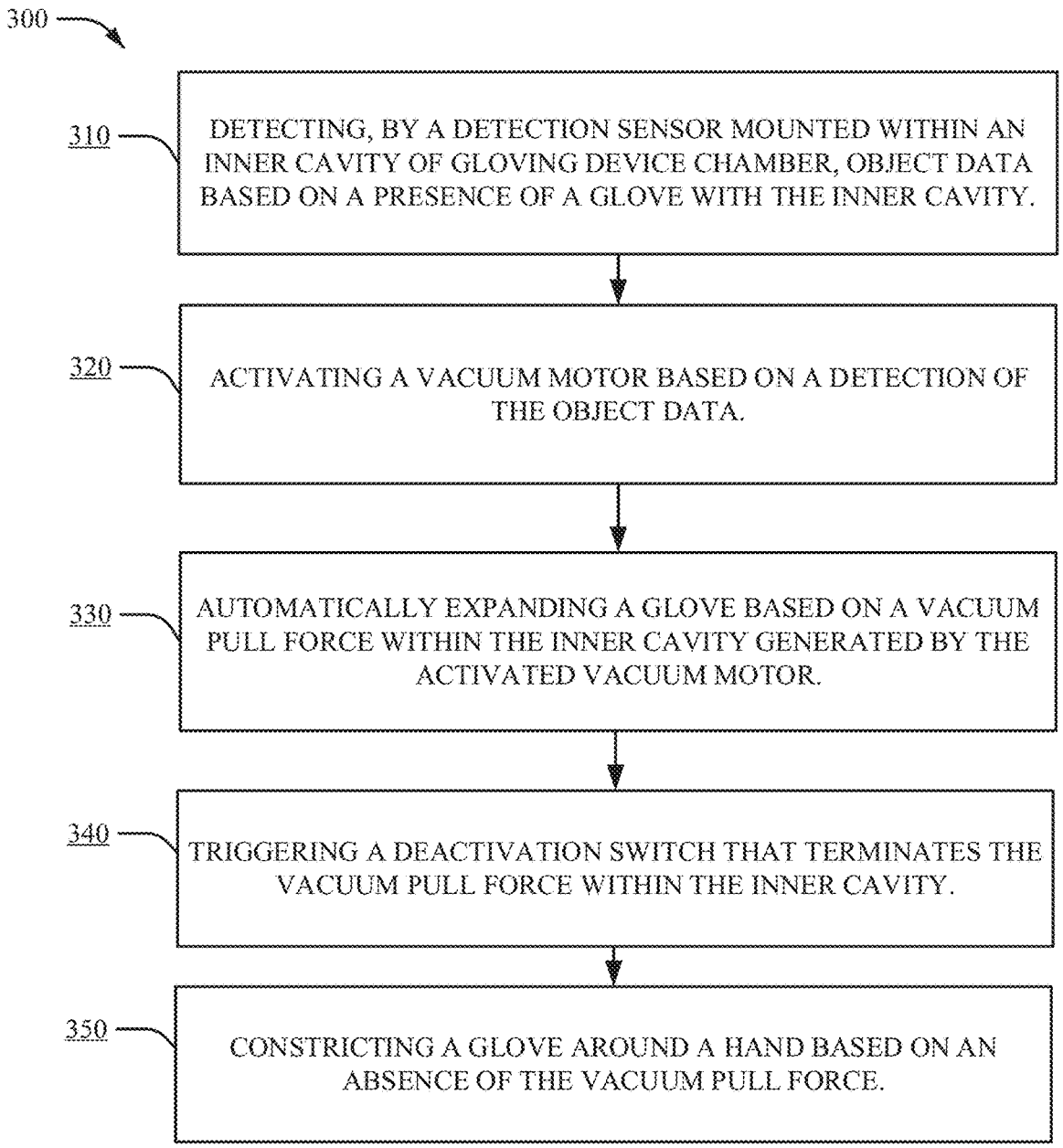
FIG. 3 illustrates a block diagram of an example, non-limiting method 300 that can facilitate a user to perform an automated fitting of a glove.

Turning now to FIG. 3, illustrated is method 300 for performing an automated fitting of a glove. At reference numeral 310, a detection sensor mounted within an inner cavity of gloving device chamber, detects (e.g., using presence sensor 230) object data based on a presence of a glove within the inner cavity. At reference numeral 320, a vacuum motor is activated based on detection of the object data. At reference numeral 330, a glove is automatically expanded based on a vacuum pull force within the inner cavity generated by the activated vacuum motor. At reference numeral 340, a deactivation switch is triggered that terminates the vacuum pull force. At reference numeral 350, the glove constricts around a hand based on the deactivation switch triggering.

In one or more non-limiting embodiments, devices 100, 200, and 300 can be integrated with computer implemented system components to execute operable instructions by a processor where such instructions are stored on a memory device. As such, the system instructions can include executing operations that control data logging operations, calibration mechanisms, vacuum force adjustments, remote monitoring and controlling of device 200. The descriptions of the various embodiments have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A method comprising:

detecting, by a detection sensor mounted within an inner cavity of a gloving device chamber, a presence of a glove within the inner cavity of the gloving device chamber of the gloving device;

generating, by a processor communicatively coupled to the gloving device, object data corresponding to the detected presence of the glove;

receiving, by a vacuum motor of the gloving device, the object data;

triggering, by the processor, an activation of the vacuum motor based on receipt of the object data;

generating, by the vacuum motor, a low pressure environment inside the inner cavity of the gloving device chamber based on a vacuum pull force created by the vacuum motor, wherein the vacuum pull force corresponds to an evacuation of air from the inner cavity of the gloving device chamber to an outside environment of the gloving device chamber via a vacuum hole to air pipe pathway of the gloving device;

expanding a glove within the inner cavity based on the low pressure environment generated by the vacuum pull force within the inner cavity of the gloving device chamber;

triggering a vacuum deactivation switch that terminates the vacuum mechanism of the vacuum motor that generates the vacuum pull force; and constricting the glove around a hand based on the deactivation switch triggering a termination of the vacuum mechanism and an increase in pressure within the inner cavity of the gloving device as compared to the low pressure environment.

2. The method of claim 1, wherein the detection sensor is a retina detection sensor that detects a presence of a user eye.

3. The method of claim 1, wherein the air pipe pathway comprises a pathway connecting the vacuum hole within a wall of the vacuum motor holder to an air in/out pipe, wherein a first end of the air in/out pipe is connected to a top surface of the vacuum motor holder and a second end of the air in/out pipe is connected to a wall of the inner cavity of the gloving device chamber.

4. The method of claim 1, wherein the vacuum deactivation switch is communicatively connected to the vacuum motor.

5. The method of claim 1, further comprising:

selecting a target pressure level to achieve within the inner cavity of the gloving device chamber based glove characteristics comprising at least one of a material composition, glove strength or glove type;

controlling, based on an adjustment to the vacuum mechanism force, the increase in pressure within the inner cavity to achieve a target pressure level of a range of pressure levels within the inner cavity of the gloving device chamber; and expanding the glove to a target state of expansion based on achieving the target pressure level.

6. The method of claim 1, wherein the detection sensor is a proximity sensor configured to detect a proximity of hand to the glove.

7. The method of claim 1, wherein the vacuum motor generates the vacuum pull force based on a motion power mechanism comprising at least one of a turbine spin mechanism or a rotating fan mechanism.

8. The method of claim 1, further comprising:

adjusting an opening size of the vacuum hole to a partial opening or full opening;

varying a degree of vacuum suction or a strength of vacuum section of the vacuum motor for predefined periods of time; and generating an increase or decrease in pressure within the inner cavity of the gloving device chamber based on the adjusting the opening size of the vacuum hole and the varying the degree of vacuum suction or the strength of vacuum suction.

9. The method of claim 1, further comprising supplying power to the gloving device via a power chord connected to the glove chamber.

10. The method of claim 1, further comprising stabilizing the glove chamber of the gloving device with a level holder element connected to an underside portion of the glove chamber.

11. The method of claim 1, further comprising sensing, by a glove presence sensor, a movement of a glove or hand within the inner cavity of the glove chamber of the gloving device;

determining, by the glove presence sensor, a magnitude of the movement based on a value corresponding to the movement to a threshold movement value; and triggering an activation of the vacuum motor based on the value determined to be greater than the threshold value.

* * * * *